US006563267B1

(12) United States Patent
Van Den Nieuwenhuizen et al.

(10) Patent No.: US 6,563,267 B1
(45) Date of Patent: May 13, 2003

(54) HIGH-PRESSURE DISCHARGE LAMP HAVING SEAL WITH EXTERNAL ANTENNA

(75) Inventors: Hubertus Cornelis Maria Van Den Nieuwenhuizen, Eindhoven (NL); Dirk Paul Joseph Vanderhaeghen, Eindhoven (NL); Guenther Hans Derra, Aachen (DE); Johannes Martinus De Regt, Cadier en Keer (NL); Antoon Joseph Bock, Landgraaf (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 168 days.

(21) Appl. No.: 09/595,308

(22) Filed: Jun. 16, 2000

(30) Foreign Application Priority Data

Jun. 16, 1999 (EP) ..... 99201927
Sep. 2, 1999 (EP) ..... 99202850

(51) Int. Cl.[7] ..... H01J 17/44; H01J 61/54

(52) U.S. Cl. ..... 313/594; 313/25; 313/623; 313/637; 313/607

(58) Field of Search ..... 313/25, 623, 624, 313/625, 634, 639, 318.12, 642, 594, 595, 601, 600, 607

(56) References Cited

U.S. PATENT DOCUMENTS 4,823,049 A * 4/1989 Sanders et al. ..... 313/623
5,323,091 A * 6/1994 Morris ..... 315/344
5,412,275 A * 5/1995 Dorsemagen et al. .. 313/318.01
5,905,338 A * 5/1999 Verspaget et al. ..... 313/623
6,198,223 B1 * 3/2001 Scholz ..... 313/623
6,268,698 B1 * 7/2001 Scholz ..... 313/631
6,294,870 B1 * 9/2001 Kawashima et al. ..... 313/623
6,326,721 B1 * 12/2001 Shippee et al. ..... 313/283

* cited by examiner

*Primary Examiner*—Nimeshkumar D. Patel
*Assistant Examiner*—Kevin Quarterman
(74) *Attorney, Agent, or Firm*—Frank Keegan

(57) ABSTRACT

The invention relates to a high-pressure discharge lamp provided with a discharge vessel made of glass which encloses a discharge space having an ionizable filling and an electrode. The discharge vessel is provided with a seal which encloses an Mo foil having knife edges and forms a feedthrough for an electric conductor to the electrode. At the location of the foil, the seal has a gastight sealed cavity and a first antenna on the outer side of the cavity. Preferably, a second antenna is placed at the neck where the seal is connected to the discharge vessel. This reduces both hot restrike voltage and hot restrike delay.

17 Claims, 4 Drawing Sheets

HIGH-PRESSURE DISCHARGE LAMP HAVING SEAL WITH EXTERNAL ANTENNA

FIELD OF THE INVENTION

The invention relates to a high-pressure discharge lamp having a quartz glass discharge vessel which encloses a discharge space with a filling comprising at least a rare gas and Hg, in which a first electrode and a second electrode are present between which a discharge extends during lamp operation, and having a first seal incorporating an electric conductor which connects the first electrode to a metal wire projecting from the first seal to the exterior, said first seal having a first and a second gastight portion between which a gas-filled cavity is present.

BACKGROUND OF THE INVENTION

A lamp of the type described is known from WO 97/48116. The known lamp is suitable for operation in air, i.e. free from an outer envelope. For lamps intended for an accurate formation of a beam by means of an optical system, this is an important advantageous aspect. Particularly for applications such as, for example, in projectors, and motor vehicle headlamps, the avoidance of optical disturbances caused by an outer envelope plays an important role. It is important that the temperature of the electric conductor has a relatively low value at the area where it is exposed to air, in order that a rapid oxidation of the conductor is prevented. In the known lamp, this is realized by elongating the seal by means of a second gastight portion spaced apart from the first gastight portion, between which a nitrogen-filled cavity is present. In this description and the claims, quartz glass is understood to mean a glass having an $SiO_2$ content of at least 95%.

In high-pressure discharge lamps, ignition delay often occurs in practice when igniting the lamp. The risk of an ignition delay strongly increases when the lamp has been in the dark for some time. The occurrence of ignition delay is a great drawback and, under circumstances, may lead to dangerous situations, for example, when using a high-pressure lamp as a motor vehicle headlamp.

SUMMARY OF THE INVENTION

It is an object of the invention to provide a measure for obtaining a lamp as described in the opening paragraph, in which the drawback described above is obviated.

According to the invention, a high-pressure discharge lamp of the type described in the opening paragraph is characterized in that the cavity comprises a further rare gas or a gaseous constituent of the filling or a combination of both, and in that the first seal has a first external antenna at the area of the cavity.

The lamp according to the invention has the advantage that, without detracting from the stability of the first seal obtained, the available cavity constitutes a start-promoting means as a source of UV radiation when applying an electric voltage across the cavity. The UV radiation source is referred to as UV enhancer.

Although it is preferred to position the UV enhancer as closely as possible to the discharge vessel, the provision of a cavity suitable as a UV enhancer in the first gastight portion of the first seal affects the mechanical strength of the first seal of the discharge vessel and is therefore not applicable in practice. For optimum beam properties of an optical system, minimal dimensions of the light source are desired, which is realized by choosing the distance between the first and the second electrode as small as possible. A practical result is that high to very high operating pressures occur in the discharge vessels of such lamps. Consequently, this imposes very strict requirements on the gastight seals of the discharge vessel. Positioning the UV enhancer at a larger distance from the discharge vessel, namely behind the first gastight portion surprisingly does not appear to detract noticeably from the ignition-promoting effect of the UV enhancer.

In an advantageous embodiment of the lamp according to the invention, the electric conductor is a foil which extends across a length of the first gastight portion, the cavity and the second gastight portion. On the one hand, this is a considerable simplification of the seal construction and its manufacture and, on the other hand, it has the important advantage that a strong concentration of an electric field is produced at the edges of the foil as soon as a voltage is applied to the conductor. This enhances breakdown in the UV enhancer.

The first seal in the lamp according to the invention is preferably a collapsed seal. This has the advantage that the glass has adhered to the electric conductor by means of flowing at the area of the first seal so that the gastight seal is free from internal stress to a considerable extent.

In a preferred embodiment of the lamp according to the invention, the first external antenna is electrically connected to the second electrode. A passive serial antenna combining a simple structure with a very reliable operation is thus realized.

In a further advantageous embodiment of the lamp according to the invention, the seal is connected to the discharge vessel at the area of a neck, and a second external antenna is present at the area of the neck. Surprisingly, the positioning of the second external antenna provides the possibility of considerably reducing the possible ignition delay upon re-ignition of the lamp directly after it has been extinguished, which effect is further referred to as hot restrike. For reasons of a simple construction, the second external antenna is preferably connected electrically to the first external antenna. The first and the second external antenna may constitute an active system in which ignition voltage pulses are exclusively applied to the antennas. In the case of a passive system, the antennas are connected to one of the electrodes, preferably the second electrode. Both in the case of an active system and in the case of a passive system, the first external antenna enhances a substantially immediate breakdown in the UV enhancer as soon as an ignition voltage pulse is applied, and the second external antenna contributes to the realization of a minimal delay upon hot restrike of the lamp. The cavity already appears to function eminently as a UV enhancer if it contains only one rare gas. This may be the rare gas which forms part of the filling of the discharge vessel. However, it is alternatively possible for the cavity to contain another rare gas, referred to as further rare gas. Preferably, the gaseous constituent of the filling in the cavity comprises mercury vapor. This has the advantage that relatively much UV radiation is generated by the UV enhancer, which particularly contributes to a rapid and reliable hot ignition. A further advantage of the lamp according to the invention is that no separate mercury dosage appears to be necessary. This is easily realizable by making the first seal after the discharge vessel has been provided with its filling. For the purpose of electrical connection of the second electrode, the lamp is provided with a second seal for feedthrough of an electric conductor to the second electrode. For reasons of an efficient production of the lamp according to the invention, this second seal has the same construction as the first seal.

The first and second external antennas can be formed by separate pieces of wire, for example, wound around the first seal. In an alternative embodiment, a single wire is wound around the first seal in such a way that both the first and the second antenna are formed. In an advantageous embodiment, each antenna is formed by a resilient clamp body which clips partly around the seal.

The first and second external antennas can be formed by separate pieces of wire, for example, wound around the first seal. In an alternative embodiment, a single wire is wound around the first seal in such a way that both the first and the second antenna are formed. In an advantageous embodiment, each antenna is formed by a resilient clamp body which clips partly around the seal.

These and other aspects of the invention are apparent from and will be elucidated with reference to the embodiments described hereinafter.

DETAILED DESCRIPTION OF THE PREFERRED EMBODIMENTS

Figure 1:
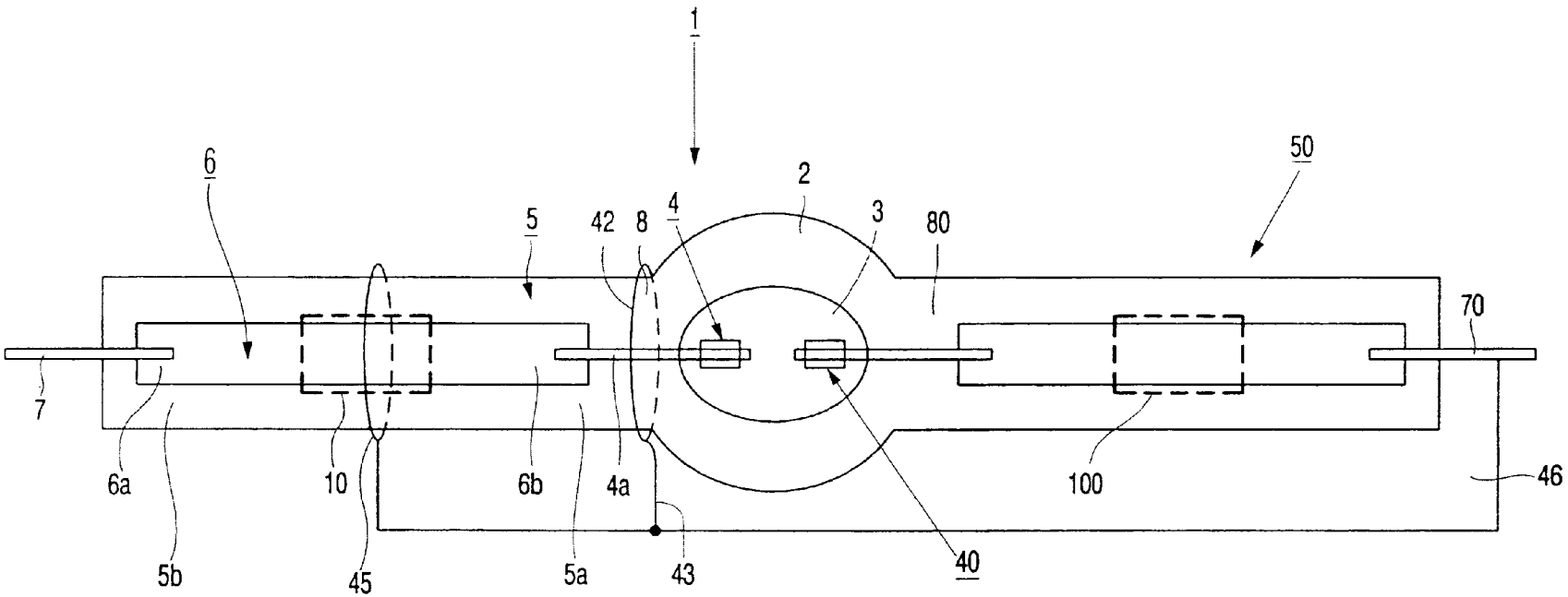
FIG. 1 shows a lamp according to the invention, comprising a collapsed seal.

FIG. 1 (not to scale) shows a high-pressure discharge lamp 1 provided with a glass discharge vessel 2 which encloses a discharge space 3 with an ionizable filling, in which a first electrode 4 and a second electrode 40 are present, between which a discharge extends during lamp operation, and having a first seal 5 incorporating an electric conductor in the form of a foil 6 which connects the first electrode 4 to a metal wire 7 projecting to the exterior from the first seal, which first seal has a first gastight portion 5*a* and a second gastight portion 5*b* between which a gas-filled cavity 10 is present. The cavity comprises at least a gaseous constituent of the filling. For example, the cavity comprises mercury vapor. At the area of the cavity, the first seal has a first external antenna 45. The first seal is connected to the discharge vessel at the area of a neck 8. At the area of the neck, a second external antenna 42 is present which is electrically connected to the first external antenna by means of a conductor 43.

The first seal 5 constitutes a collapsed seal. The foil 6 is an Mo strip having knife edges. The metal wire 7 is secured to one end 6*a* of the foil 6, for example, by welding and projects to the exterior from the seal and from the discharge vessel. An electrode rod 4*a* of the first electrode 4 is secured to a further end 6*b* of the foil 6. On the side facing the first electrode 4, the discharge vessel of the second electrode 40 and a second seal 50, with a cavity 100 and a neck 80, has a comparable construction. The second electrode is connected to a wire 70. In the operating condition of the lamp, a discharge extends between the electrodes. In the embodiment described, the first and the second external antenna 45, 42 are electrically connected to the second electrode 40 by means of a conductor 46. A very reliable passive serial antenna is thus realized in an extremely simple manner.

Figure 2A:
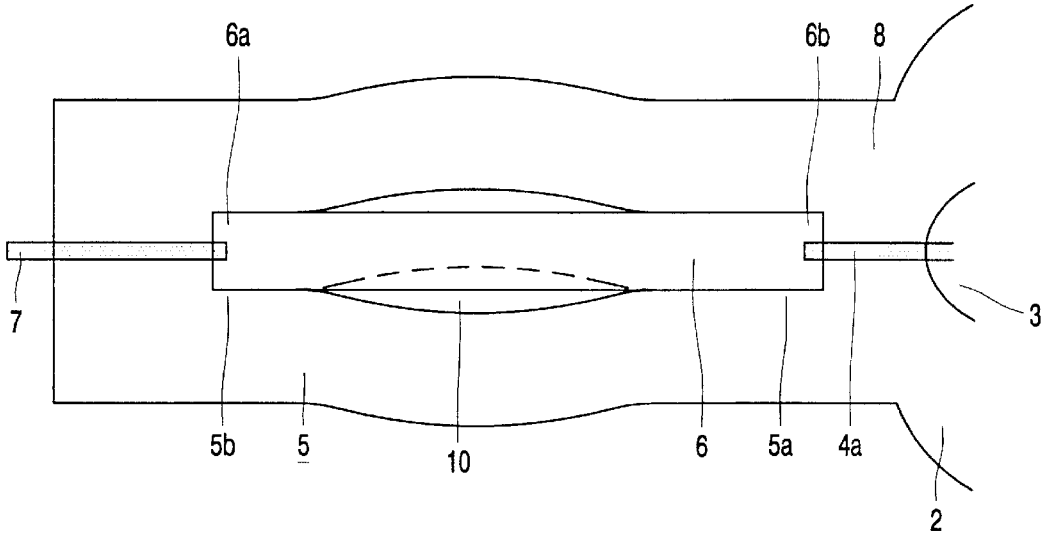
FIG. 2 shows the collapsed seal of FIG. 1 in detail.
Figure 2B:
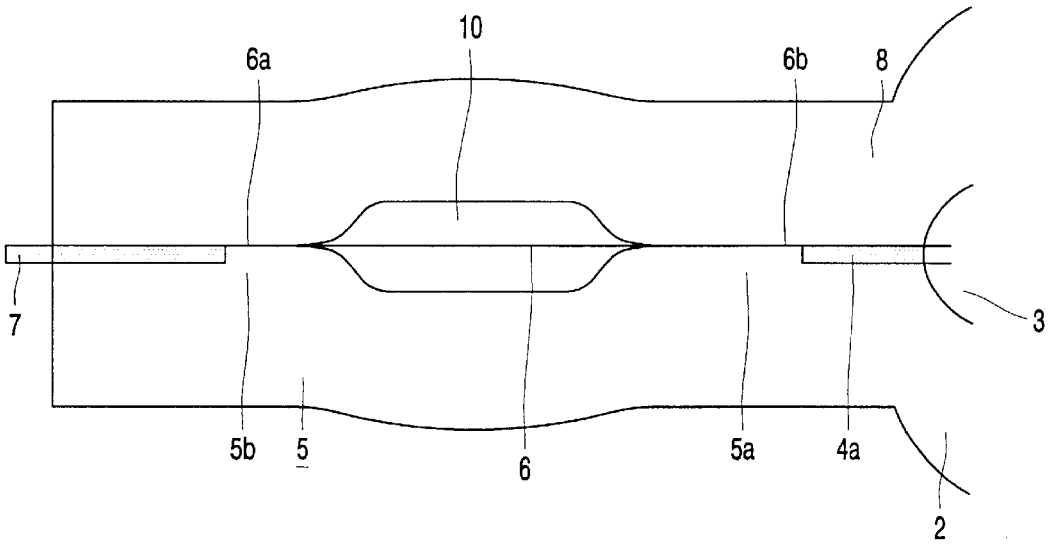

FIG. 2 (not to scale) shows the first collapsed seal of the lamp of FIG. 1 in detail, in which FIG. 2A shows the first seal with foil 6 in a plan view and FIG. 2B shows it with foil 6 in a side elevation. In FIG. 2, the antennas 45 and 43 are not shown for the sake of clarity.

Figure 3:
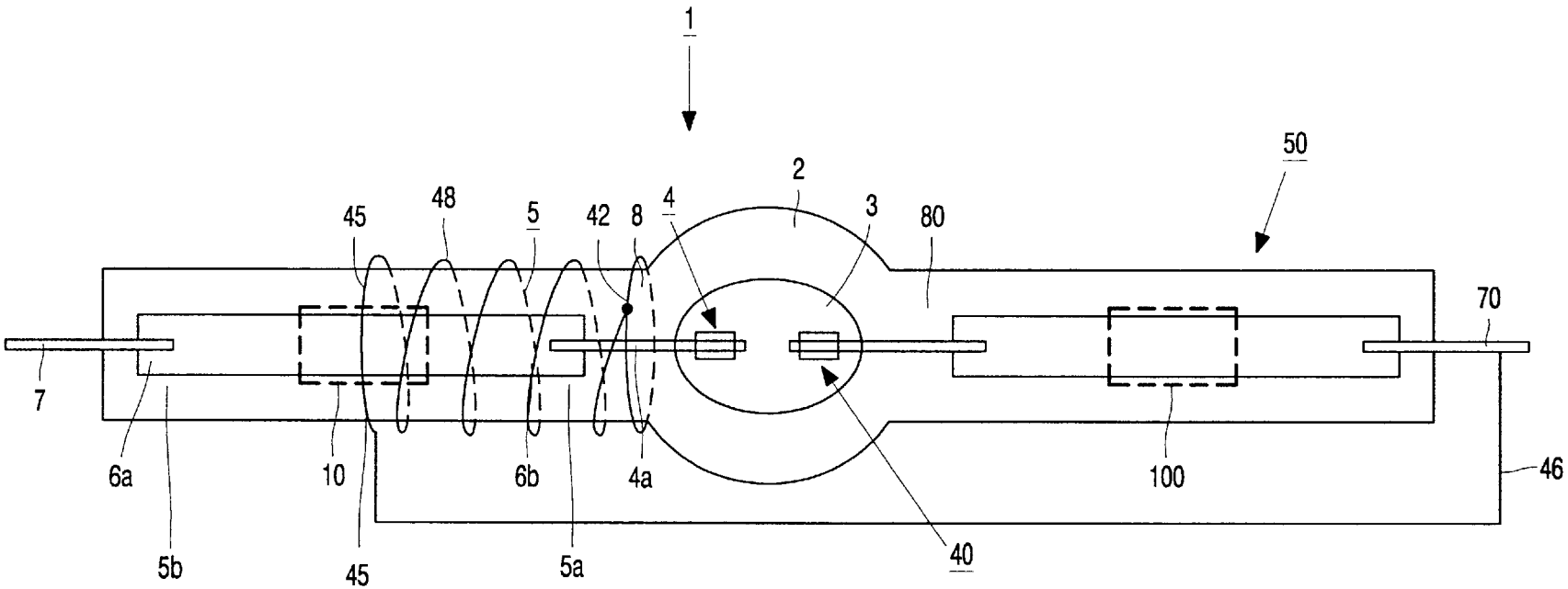
FIG. 3 shows a further embodiment of the lamp according to the invention.

In a further embodiment of the lamp according to the invention, shown in FIG. 3, the first antenna 45 is a first wire loop of a wire 48 at the area of the cavity 10, which is wound with some turns around the first seal 5 as far as the neck 8 where it forms the antenna 42. This embodiment is advantageous because of the possibility of a simple construction of the antennas 45 and 42 and the conductor 46, formed from a single wire.

Figure 4:
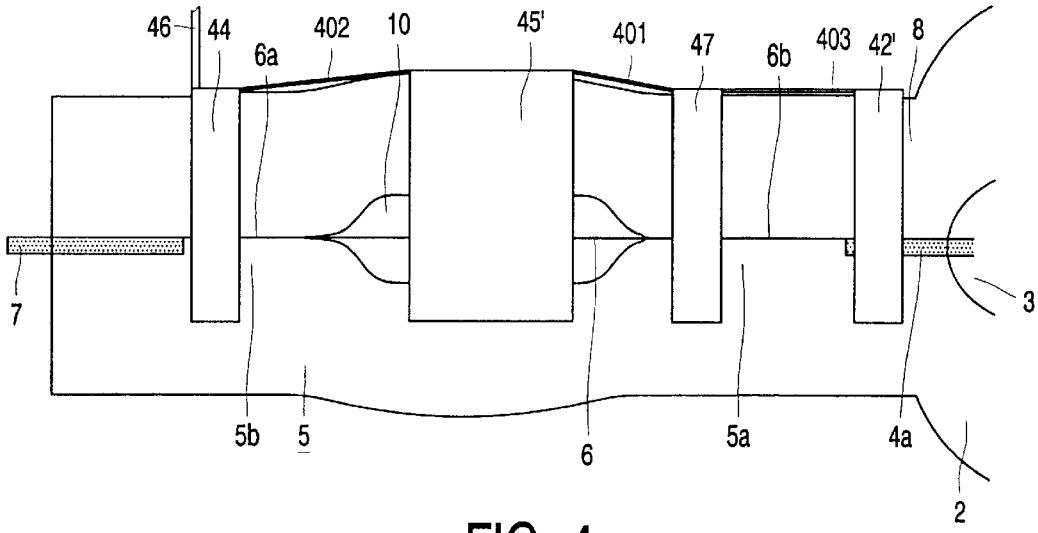
FIG. 4 shows a seal provided with a resilient clamp body.
Figure 5:
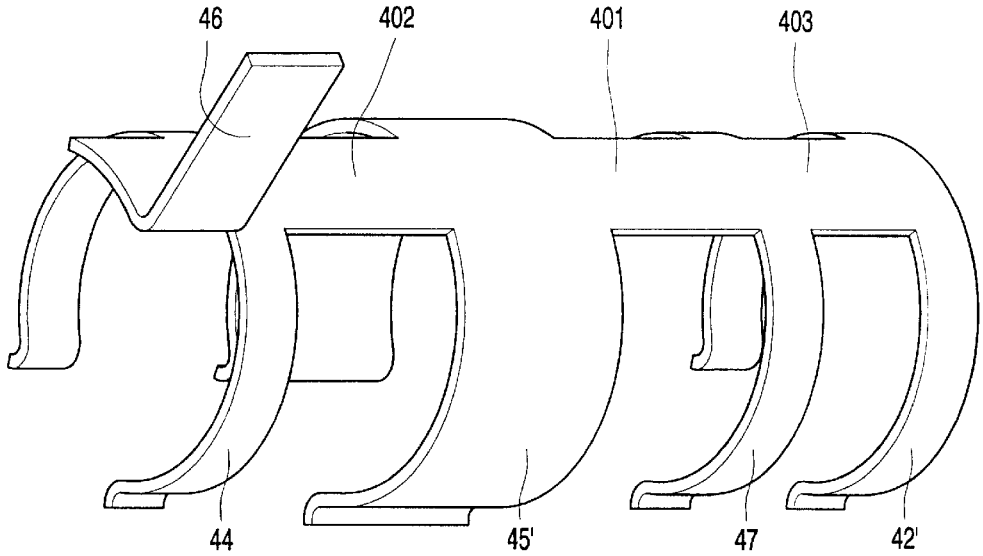
FIG. 5 shows a side view of the resilient clamp body.

In an advantageous embodiment of the lamp, the antennas are formed as resilient clamp bodies. FIG. 4 shows (not true to scale) how the first seal is provided with such antennas. In the embodiment shown, the first seal, which has a substantially round circumference, is clamped by four resilient clamp bodies. A first resilient clamp body 45' located at the cavity forms the first antenna and a second resilient claim body 42' located at the neck 8 forms the second antenna. A third resilient clamp body 44 is located close to the second gastight portion 5*a* of the first seal. The conductor 46 is connected to the resilient clamp body 44. A fourth resilient clamp body 47 is provided in between the resilient clamp bodies 45' and 42'. The resilient clamp bodies 44, 42', 45', 47 are interconnected by connection bodies 401, 402, 403. Due to the presence of the cavity 10, the circumference of the first seal is somewhat larger at the cavity than on either side thereof. Preferably the fourth resilient clamp body is located immediately beside the larger circumference. The shown configuration has the advantage that the position of the first antenna 45' is substantially fixed in this way due to the differences in the circumference. A further advantage is that the antennas can be produced as separate lamp parts and can be mounted on the lamp in a simple way afterwards. Preferably, the resilient clamp bodies and the connection bodies are made in one piece. FIG. 5 shows a side view of the resilient clamp bodies 44, 45', 42', 47 and connection bodies 401, 402, 403 made in one piece.

In a practical realization of the lamp in accordance with the embodiment shown, the lamp is a high-pressure mercury discharge lamp having a nominal power of 120 W. The lamp, which is intended for projection purposes, has a discharge vessel with an internal diameter of 4 mm and an electrode distance of 1 mm. The discharge vessel has an ionizable filling which, in addition to mercury and a rare gas, for example, argon having a filling pressure of 100 mbar, also comprises bromine. During operation of the lamp, a pressure of 160 bar or more prevails in the discharge vessel. The discharge vessel is made of quartz glass having a largest thickness of 2.5 mm. The knife-edged strip is an Mo strip to which a metal wire is secured at one end. A W electrode rod of a first electrode is secured to the other end of the strip. The lamp is provided on each side with a collapsed seal each having a length of 28 mm. A length of 5 mm of the collapsed seal is already adequate for hermetically sealing the discharge vessel. The remaining length of the collapsed seal is used to give the temperature of the electric conductor a sufficiently low value at the area where it is exposed to air. Each collapsed seal has a cavity. Each collapsed seal has a length of 7 mm between the discharge space and the relevant cavity. Each cavity has a length of 5 mm.

The first seal of this practical realization is provided with a first antenna at the area of the cavity, in the form of a wire winding which extends in 2 to 3 turns as far the neck between the seal and the discharge vessel, where it forms a second antenna in a closed winding. The second antenna is spaced apart from the discharge space through a distance of between 1 mm and 3 mm. The wire has a diameter of 5 mm. The wire is electrically connected to a second electrode.

In a further practical realization the first seal is provided with four resilient clamp bodies made of an electrically conductive, heat-resistant material, in the described case stainless steel RVS310. The resilient clamp body located at the cavity has a width of 3 mm. The other resilient clamp bodies each have a width of 1 mm. The resilient clamp bodies are interconnected by connection bodies having a width of 2 mm. The resilient clamp bodies and the connection bodies are made from one piece of material.

The lamp manufacture starts from a quartz glass tube in which a vessel is formed which is provided with tubular parts at two diametrically opposed locations, which tubular parts will serve for the manufacture of seals. First, a seal is made on the lamp vessel, for example a collapsed seal after a knife-edged strip and a conductor and electrode secured thereto in known manner have been provided, which collapsed seal is realized by heating the relevant tubular part in such a way that it softens and flows out under the influence of a prevailing sub-atmospheric pressure. This is preferably done by means of a laser beam rotating with respect to the tubular part, which rotating beam is moved from the conductor towards the electrode rod. By interrupting the laser beam at the location of the strip for some time, a gastight cavity is realized. The cavity thus formed comprises a gas which is present in the tubular part and the discharge space during manufacture of the collapsed seal. This is generally a rare gas with which the quartz glass tube is rinsed during manufacture of the seal. For reasons of an efficient manufacture, the rare gas which will form part of the filling of the discharge vessel will preferably be used for this purpose. Subsequently, the discharge vessel is provided with the constituents required for the filling, whereafter a knife-edged strip with secured electrode and ditto conductor is provided at the area of the other tubular part. Subsequently, a collapsed seal is made in a corresponding manner also in the other tubular part by heating and consequent flowing of the tubular part. The cavity thus formed is thus also automatically filled with vapor of the filling present in the discharge vessel, particularly mercury vapor. This is a great advantage for a satisfactory start-enhancing operation. It has been found that the collapsed seals thus formed qualitatively constitute equally good seals as in the case where the collapsed seals do not have a gastight cavity.

A practical lamp of the type described above requires a voltage of 1 kV for cold ignition, for example a voltage in the form of a high-frequency signal during 1 to 3 ms of, for example, 50 kHz for generating a breakdown in the cavity whereafter substantially instantsneously a discharge is produced in the discharge vessel between the electrodes, which will subsequently develop to a stable discharge arc so that the lamp operates in a stable manner. The lamp reaches its stable operating state after not more than 1 minute. In the same practical lamp, a maximum strike delay occurs after extinction of the lamp upon hot restrike of the lamp by means of a high-frequency signal of 5 kV of at most 60 s, with the power supplied during hot restrike to the lamp remaining limited to 120 W.

In the case of a comparable lamp without a cavity in one of the seals, the required ignition voltage is 20 kV under otherwise equal conditions.

What is claimed is:

1. A high-pressure discharge lamp comprising:

a quartz glass discharge vessel, said discharge vessel enclosing a discharge space with a filling of at least a rare gas and mercury, a first electrode and a second electrode being present in said discharge space, a discharge extending between said first and second electrodes during lamp operation, the discharge vessel having a seal incorporating an electric conductor which connects the first electrode to a metal wire projecting from the seal to the exterior of the discharge vessel, the seal having a first and a second gastight portion between which a gas-filled cavity is present, the cavity containing a further rare gas or a gaseous constituent of the filling or a combination of both, the seal having a first external antenna at the area of the cavity, and the seal being connected to the discharge vessel at the area of a neck, and a second external antenna being present at the area of the neck.

2. A lamp as claimed in claim 1, wherein the electric conductor is a foil which extends through a length of the first gastight portion, the cavity and the second gastight portion.

3. A lamp as claimed in claim 1 wherein the seal is a collapsed seal.

4. A lamp as claimed in claim 1, wherein the first external antenna is electrically connected to the second electrode.

5. A lamp as claimed in claim 1, wherein the second external antenna is electrically connected to the first external antenna.

6. A lamp as claimed in claim 1, wherein the gaseous constituent of the filling in the cavity comprises mercury vapor.

7. A lamp as claimed in claim 1, wherein the first external antenna is formed by a first resilient clamp body which clips partly around the seal.

8. A lamp as claimed in claim 7, wherein the second external antenna is formed by a second resilient clamp body which clips partly around the seal.

9. A lamp as claimed in claim 8, wherein the first and second resilient clamp bodies are interconnected by a connection body and that the first and second resilient clamp bodies and the connection body are made from one piece of material.

10. A high-pressure discharge lamp comprising:

a quartz glass discharge vessel enclosing a discharge space with a filling of at least a rare gas and mercury, a first electrode and a second electrode in the discharge space, the discharge lamp being configured to maintain an electric discharge between the first electrode and the second electrode during lamp operation, the discharge vessel having a seal enclosing an electric conductor, the seal being connected to the discharge vessel at a neck, the electric conductor being connected to the first electrode and being connected to a metal wire projecting from the seal to the exterior of the lamp, the seal having a first and a second gastight portion and a cavity between said first gastight portion and second gastight portion, the cavity containing a gas which is a further rare gas or one or more of the gaseous constituents of the filling or a combination of a further rare gas and one or more of the gaseous constituents of the filling, the seal being at least partially surrounded by a first external antenna at the area of the cavity and at least partially surrounded by a second external antenna at the area of the neck.

11. A lamp as claimed in claim 10, wherein the first external antenna is electrically connected to the second electrode.

12. A lamp as claimed in claim 10, wherein the second external antenna is electrically connected to the first external antenna.

13. A lamp as claimed in claim 10, wherein the first external antenna is formed by a first resilient clamp body clamped at least partly around the seal.

14. A lamp as claimed in claim 10, wherein the second external antenna is formed by a second resilient clamp body clamped at least partly around the seal.

15. A lamp as claimed in claim 10, wherein the first external antenna is formed by a first resilient clamp body; and the second external antenna is formed by a second resilient clamp body, the first and second resilient clamp bodies being clamped at least partly around the seal; the first and second resilient clamp bodies being interconnected by a connection body; and the resilient clamp bodies and the connection body being made from one piece of material.

16. A high-pressure discharge lamp comprising:

a discharge vessel enclosing a discharge space with a filling;

a first electrode and a second electrode in the discharge space configured to maintain an electric discharge in the discharge space during lamp operation;

an electric conductor enclosed in a seal of the discharge vessel, the seal being connected to the discharge vessel at a neck, the electric conductor being connected to the first electrode and to a metal wire projecting from the seal to the exterior of the lamp;

the seal having a first and a second gastight portion and a cavity between said first gastight portion and second gastight portion;

the cavity containing a gas which is a further rare gas or one or more of the gaseous constituents of the filling or a combination of a further rare gas and one or more of the gaseous constituents of the filling, said cavity being isolated from said discharge space and surrounding an entire width of said electric conductor; and a first external antenna at least partially surrounding the seal at the area of the cavity.

17. The high-pressure discharge lamp of claim 16, further comprising a second external antenna at least partially surrounding the seal at the area of the neck.

* * * * *